United States Patent [19]

Nakazawa et al.

[11] Patent Number: 4,457,961

[45] Date of Patent: Jul. 3, 1984

[54] PEARLY-LUSTERED CONTAINER

[75] Inventors: Hidezi Nakazawa, Tochigi; Yoshiharu Hatakeyama, Tokyo, both of Japan

[73] Assignee: Yoshida Industry Co., Ltd., Tokyo, Japan

[21] Appl. No.: 465,680

[22] Filed: Feb. 10, 1983

[30] Foreign Application Priority Data

Feb. 15, 1982 [JP] Japan ..... 57-18404

[51] Int. Cl.[3] ..... B65D 35/08

[52] U.S. Cl. ..... 428/35; 428/216; 428/324; 428/328

[58] Field of Search ..... 428/30, 35, 204, 324, 428/216, 328; 206/457; 229/3.5 R

[56] References Cited

FOREIGN PATENT DOCUMENTS 53-79684 7/1978 Japan .
54-7485 1/1979 Japan .
54-10318 5/1979 Japan .

*Primary Examiner*—George F. Lesmes
*Assistant Examiner*—P. R. Schwartz
*Attorney, Agent, or Firm*—Wenderoth, Lind & Ponack

[57] ABSTRACT

A pearly-lustered container includes, a body of a triple-layer structure. A thin outer layer is formed of a synthetic resinous material mixed with powdered pearl essence for giving a pearly luster. A relatively thick intermediate layer is formed of a transparent synthetic resinous material mixed with coloring pigment for bringing out a desired color tone. An inner layer is formed of a white opaque synthetic resinous material to function as a screen.

1 Claim, 2 Drawing Figures

FIG. 1
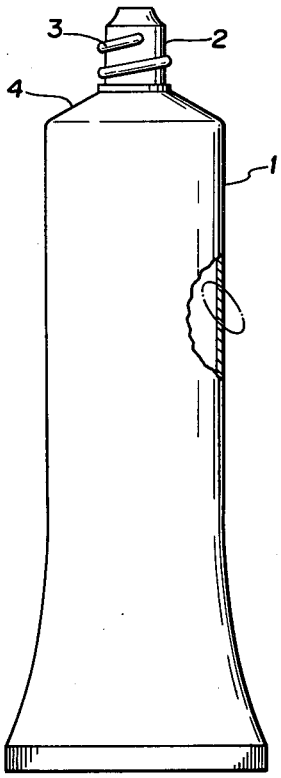
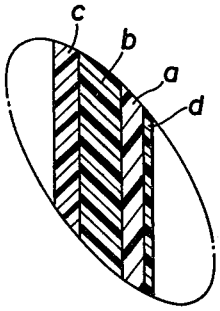
FIG. 2

PEARLY-LUSTERED CONTAINER

BACKGROUND OF THE INVENTION

The present invention relates to a pearly-lustered container suitable for use with cosmetics or the like.

A conventional pearly-lustered container of this kind is proposed, for example, in Japanese Patent Publication No. 41596/78, according to which the container body has a double-layer structure composed of an outer layer of a transparent synthetic resinous material mixed with a predetermined amount of pearly essence and an inner layer of an opaque synthetic resinous material colored in a desired color. It is described in this prior art literature that, with such a structure, since rays of light incident on the container are diffuse-reflected by pearl essence particles mixed in the transparent resin of the outer layer, the container surface assumes a pearly luster, and that when the outer layer is sufficiently thick, light reflected from the neighborhood of the outer layer surface and light diffuse-reflected by the pearl essence particles distributed throughout the outer layer are superimposed on each other to add a cubic effect to the appearance of the container. In practice, however, containers of this prior art arrangement, now on the market, have their outer and inner layers both formed of polyethylene resin to a thickness of about 250 microns. The polyethylene resin is very economical and the most practical resin but has poor transparency. Therefore, as the thickness of the layer increases, its light transmission efficiency gradually decreases, finally resulting in the layer becoming almost semitransaprent. Accordingly, an increase in the thickness of the outer layer permits an increase in the amount of pearl essence mixed in the layer but, in this case, although the reflectivity of incident light which is reflected by the pearl essence particles present near the surface of the outer layer is high, the reflectivity by the pearl essence particles deep in the outer layer in the vicinity of the inner layer is impaired by the low transparency of the polylethylene resin. Furthermore, in order to make the container attractive in appearance, the opaque inner layer is colored by using a coloring pigment so that coloring agent particles may be seen through the outer layer. Accordingly, an increase in the amount of pearl essence mixed for heightening the pearly luster impairs the light transparency of the outer layer. Thus, the amount of pearl essence mixed in the outer layer is also limited.

With such a conventional pearly-lustered container as described above, a decrease in the amount of pearl essence employed decreases the quantity of light reflected by the pearl essence particles and, in addition, only the pearl essence particles in the vicinity of the surface of the outer layer contribute to radiation of the pearly luster, and the pearl essence particles deep in the outer layer do not much contribute to it. Moreover, mixing of the pearl essence which does not much contribute to radiation of the pearly luster is economically disadvantageous because the pearl essence itself is expensive.

SUMMARY OF THE INVENTION

It is therefore an object of the present invention to provide a pearly-lustered container which is free from the abovesaid defects of the conventional containers, brilliant with a pearly radiance and economically advantageous.

Briefly stated, the container of the present invention has a thin outer layer of a synthetic resinous material mixed with a required amount of powdered pearl essence for giving a pearly luster, a relatively thick intermediate layer of a transparent or semitransparent synthetic resinous material mixed with a predetermined amount of coloring pigment for producing therein a desired color tone, and an inner layer of a white opaque synthetic resinous material for forming a background.

According to the present invention, rays of light incident on the outer surface of the container are in part diffuse-reflected by pearl essence particles for producing the pearly luster and in part reflected at the boundary between the outer and the intermediate layer, and these reflected rays are superimposed on each other to give a splendid pearly luster to the container surface on a background of a desired color tone.

BRIEF DESCRIPTION OF THE DRAWINGS

FIG. 1 is a front view of a tubular container embodying the present invention, and FIG. 2 is an enlarged sectional view of the circled portion of FIG. 1.

DESCRIPTION OF THE PREFERRED EMBODIMENTS

FIG. 1 illustrates an embodiment of the present invention as being applied to a tubular container. A neck portion 2 of a tubular body 1 has an opening at its upper end for taking out the contents of the tube. On the neck portion 2 are formed screw threads 3 which helically extend around its outer peripheral surface for threaded engagement with a container cap. The lower end of the neck portion 2 adjoins a funnel-shaped shoulder portion 4 of the tubular body 1. As shown in the enlarged sectional view of FIG. 2 the the body 1 has a triple-layer structure comprising an outer layer a, an intermediate layer b and an inner layer c. The outer layer is a thin, preferably 90 to 110 micron thick, layer formed of colorless or transparent polyethylene resin mixed with a required amount of very fine pearl essence powder containing, as basic components, mica, titanium and so forth for giving a pearly luster to the container. The reduced thickness of this layer is to keep its transparency high. The intermediate layer b is formed of transparent resin of olefine series mixed with a required amount of pigment of transparent or semitransparent desired color tone to make the layer transparent or translucent in the desired color tone. It is desirable that the intermediate layer b be formed as thick as possible, preferably, 200 to 300 microns, so as to add a feeling of depth to the appearance of the container and provide it with chemical and physical strength.

The inner layer c is formed of white opaque synthetic resin of olefine series colored by titanium white or the like. The outer, intermediate and inner layers a, b and c are formed as a unitary structure with one another. It is also possible to coat the outer surface of the outer layer a with a transparent film d which protects a trade name or the like printed thereon and gives a luster thereto.

According to the illustrated embodiment, the container body 1 has a laminated structure of three layers, i.e. the outer, intermediate and inner layers a, b and c as described above. The three layers can easily be formed by extrusion molding as a unitary structure with one another through using three extruders connected to a die. The coating of the outer surface of the outer layer a can be effected by continuously forming a transparent film as of polyester series through the use of a coating machine after the formation of the container body 1.

As described above, the container body of the pearly-lustered container of the present invention is composed of a thin outer layer of synthetic resin mixed with a required amount of powdery pearl essence for giving a pearly luster, such as mica, titanium and so on, an intermediate layer of colorless synthetic resin mixed with a predetermined amount of transparent or translucent coloring pigment for producing a desired color tone, and an inner layer of white opaque synthetic resin for forming a background. With such a structure, light incident on the container, after refracted by the transparent film d forming a surface layer, enters the outer layer a to strike against shiny fine particles of the pearl essence innumerably scattered in the outer layer a, and a pearly luster is given by diffuse reflection from the surfaces of the particles. The incident rays of light in part pass between the pearl essence particles to enter the intermediate layer b but, on account of different refractive indexes of the outer and intermediate layers a and b, the incident rays are in part reflected at the boundary between the two layers to shine on the pearl essence particles from behind in the outer layer a and they are diffusely reflected back to the outside of the container. In this case, since the outer layer a is thin, the attenuation of the reflected light is small and the diffuse reflection of the reflected light also effectively gives the pearly luster. The light which is not reflected at the boundary between the outer and intermediate layers a and b is refracted by the intermediate layer b to strike against transparent or translucent coloring pigment particles present in the intermediate layer b and only colored light specified by the pigment passes through the pigment particles to shine on the background formed by the inner layer c of opaque white resin.

By such an action of the incident light, the light reflected from the surfaces of the pearl essence particles in the outer layer a and the light reflected at the boundary between the outer layer a and the intermediate layer b and reflected from the back of each pearl essence particle in the outer layer a are superimposed on eah other. Accordingly, as compared with providing pearly luster by reflected light from the surface of the pearl essence particles as in the conventional pearly-lustered container, the container surface of the invention assumes a profound and gorgeous luster by virtue of the light reflected from the back of the pearl essence particles. Moreover, since the pearly luster is given on a background of a desired color formed by the colored transparent intermediate layer b on the white inner layer c, the cubic effect of the pearly luster is heightened. Besides, according to the present invention, since the pearl essence for providing the pearly luster is mixed in a thin layer, the pearl essence can be utilized more effectively than in the case of mixing the pearl essence in a thick layer. Therefore, the container of the present invention also is advantageous from the economical point of view.

It will be apparent that many modifications and variations may be effected without departing from the scope of the novel concepts of the present invention.

What is claimed is:

1. A pearl-like lustered container having a hollow body comprising:

an inner layer formed of a white opaque synthetic resinous material and forming a viewing background;

an intermediate layer having a thickness of 200 to 300 microns and formed of a transparent synthetic resinous material mixed with a predetermined amount of a coloring pigment to thereby render said intermediate layer transparent or translucent in a desired color tone;

an outer layer having a thickness of 90 to 110 microns and formed of a colorless synthetic resinous material mixed with a predetermined amount of powdered pearl essence, thereby imparting a pearl-like luster to the container; and a protective surface film covering said outer layer and formed of a transparent material;

whereby one portion of light passing through said surface film enters said outer layer and diffusely reflects from particles of said pearl essence therein, another portion of said light reflects from the boundary between said intermediate and outer layers and shines on and diffusely reflects from behind said particles, and a further portion of said light passes through said intermediate layer as colored light colored by particles of said pigment therein, and thereby the color and the pearl-like luster are viewed against said background of said inner layer.

* * * * *